US006718595B1

(12) United States Patent
Berger, Jr.

(10) Patent No.: US 6,718,595 B1
(45) Date of Patent: Apr. 13, 2004

(54) HINGE ASSEMBLY WITH SELF LUBRICATED PIN

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 0 days.

(21) Appl. No.: 10/252,141

(22) Filed: Sep. 23, 2002

(51) Int. Cl.[7] ..... E05D 11/00
(52) U.S. Cl. ..... 16/273; 16/390
(58) Field of Search ..... 16/273, 389, 390, 16/267, 355; 160/224, 228, 229.1

(56) References Cited

U.S. PATENT DOCUMENTS

| | | | | | |
|---|---|---|---|---|---|
| 1,936,237 | A | * | 11/1933 | Johnson | 16/386 |
| 3,451,124 | A | * | 6/1969 | Steiner et al. | 29/527.1 |
| 3,921,225 | A | * | 11/1975 | Suska | 16/273 |
| 4,205,713 | A | * | 6/1980 | Galbreath | 160/201 |
| 4,256,388 | A | * | 3/1981 | Beyer | 351/158 |
| 4,353,146 | A | * | 10/1982 | Brockhaus | 16/387 |
| 4,807,330 | A | * | 2/1989 | Gomes | 16/261 |
| 4,964,193 | A | | 10/1990 | Rommelfaenger et al. | 16/225 |
| 5,706,556 | A | * | 1/1998 | Kluting | 16/273 |
| 6,076,590 | A | * | 6/2000 | Ford et al. | 160/229.1 |
| 6,173,475 | B1 | * | 1/2001 | Senn et al. | 16/273 |

FOREIGN PATENT DOCUMENTS

| | | | | |
|---|---|---|---|---|
| DE | 3021310 | A1 * | 12/1981 | |
| FR | 2623553 | | 5/1989 | 16/260 |

* cited by examiner

*Primary Examiner*—Chuck Y. Mah
(74) *Attorney, Agent, or Firm*—J. Sanchelima; A. Bordas

(57) ABSTRACT

A hinge assembly for garage doors with relatively loose tolerance for the leaf assemblies and the central supporting member. A sleeve is rotably mounted over the supporting member and a folded portion of the leaf assembly journals the sleeve for a substantially frictionless linkage. The sleeve is made of a self-lubricating plastic material to reduce noise.

3 Claims, 4 Drawing Sheets

HINGE ASSEMBLY WITH SELF LUBRICATED PIN

BACKGROUND OF THE INVENTION

1. Field of the Invention

The present invention relates to a hinge assembly, and more particularly, to a hinge with self-lubricated rotably mounted sleeve.

2. Description of the Related Art

Many designs for hinge assembly have been designed in the past. None of them, however, include a self-lubricated sleeve that facilitates the movement of the hinge leaves with reduced levels of noise.

Applicant believes that the closest reference corresponds to U.S. Pat. No. 4,964,193 issued to Rommelfaenger et al. on Oct. 23,1990 for a hinge including two leaves with interengaging knuckles. The Rommelfaenger's patented hinge has a plastic coated metal hinge pin that extends through the knuckles and the knuckles are crimped onto the plastic coated hinge pin. In the Rommelfaenger's patent, the tighter the knuckles grip the pin, the greater will be the torque required to operate the hinge. However, it differs from the present invention because the Rommelfaenger's patented invention includes a plastic coating intended to provide a more friction while the present invention includes a plastic self-lubricated rotably mounted sleeve intended to provide practically no friction and substantially noiseless. The more lax specifications of some hinges (garage door hinges) do not require a tight engagement of the central pin and the knuckles.

Applicant believes that another related reference corresponds to French patent No. 2,623,553 issued to Boismain on May 26, 1989 for a hinge with lateral engagement for a leaf and the like. Boismain's patented hinge includes an strip (33) made of self-lubricating material intended for easily engaging and removing the leaves by a horizontal movement. However, the disposition of the loop (21) against shoulder (7) causes metal friction and therefore noisy movement of the hinge.

For garage door applications there is no need for tight tolerances for the knuckles, which makes them more expensive. It is nevertheless desirable to have a noiseless hinge, even for garage doors.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hinge assembly with plastic self-lubricated sleeve intended to reduce hinge friction of the leaves with the central pin.

It is another object of this invention to provide a hinge assembly with plastic self-lubricated sleeves rotably mounted over a central supporting member to facilitate a noiseless movement.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
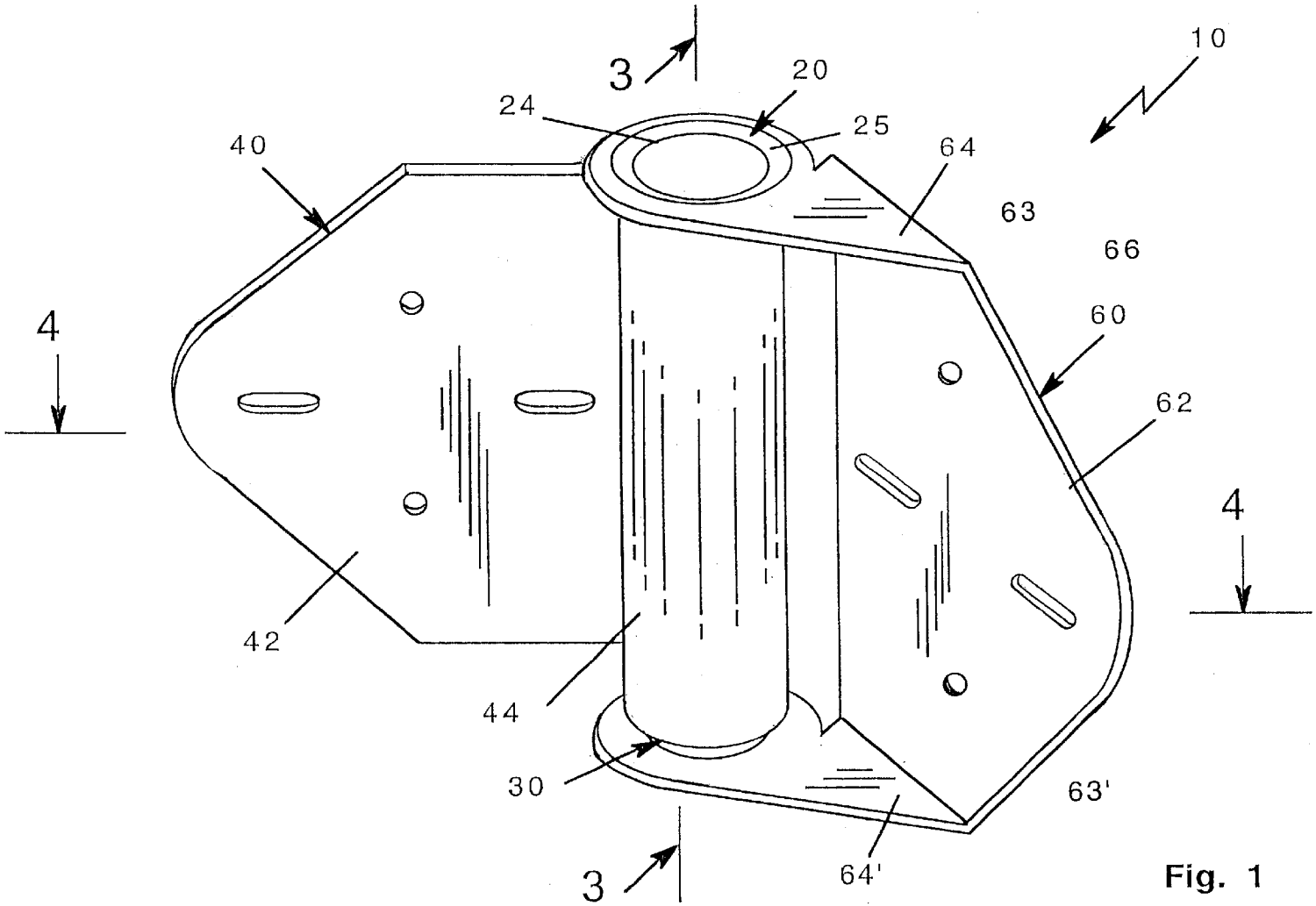
FIG. 1 represents an isometric view of the hinge assembly object of the present invention.

Referring now to the drawings, where the present invention is generally referred to with numeral 10, it can be observed that it basically includes supporting member 20, sleeve member 30 and leaf assemblies 40 and 60.

Figure 2:
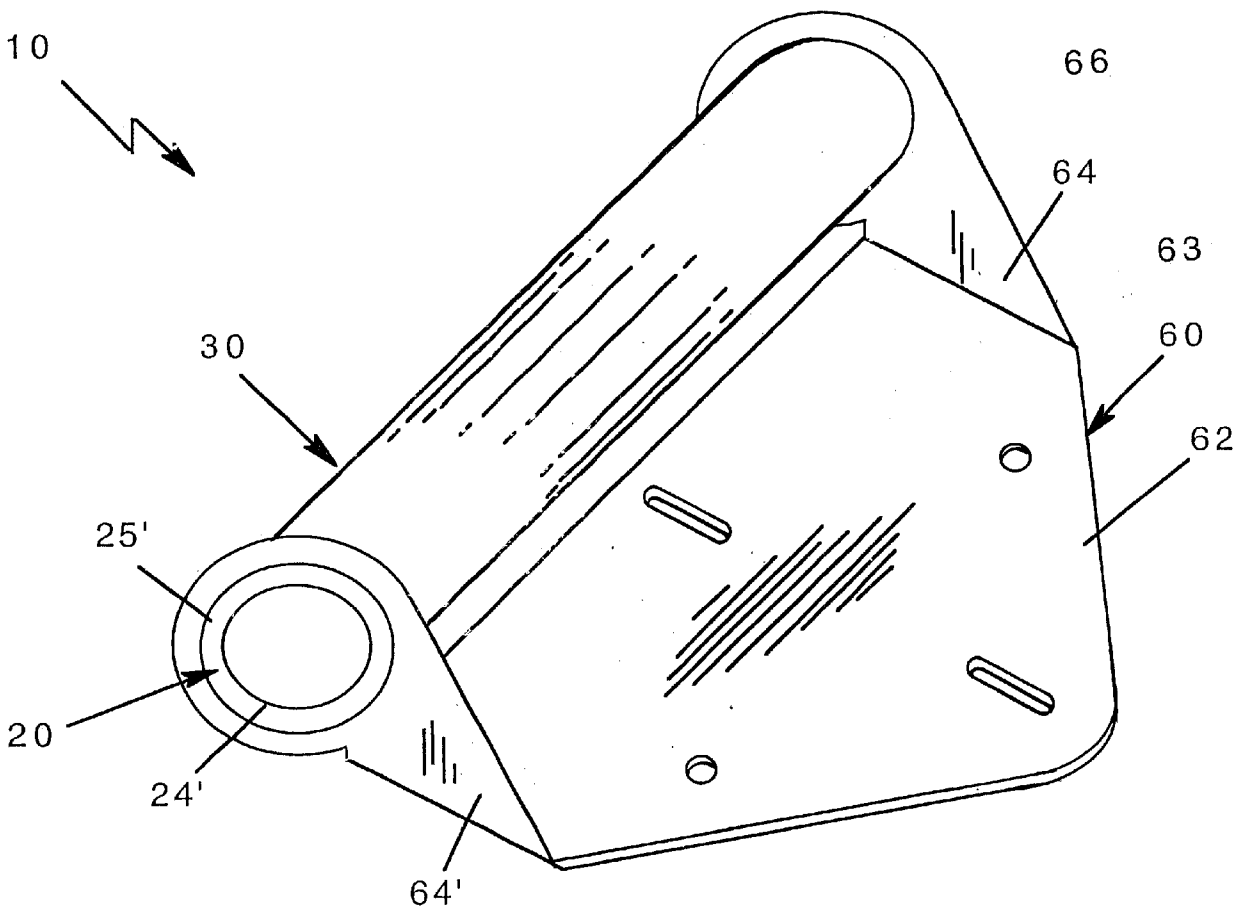
FIG. 2 is an isometric view of the supporting member and one of the leaf assemblies, showing the ends of the former rigidly mounted to the angular walls of the leaf assembly.
Figure 3:
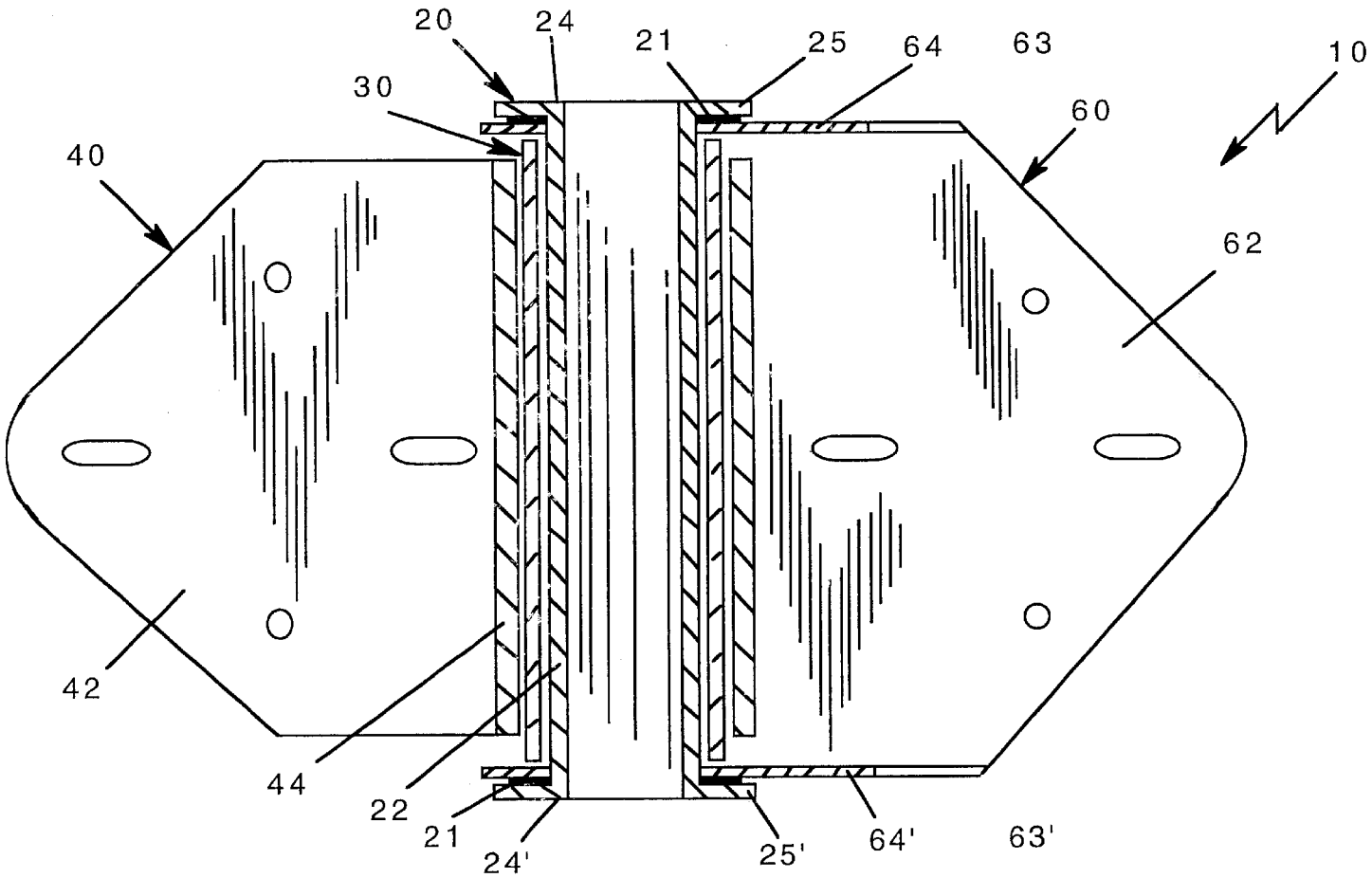
FIG. 3 shows a front elevational view of the invention partially cross-sectioned to show the central tubular member.
Figure 4:
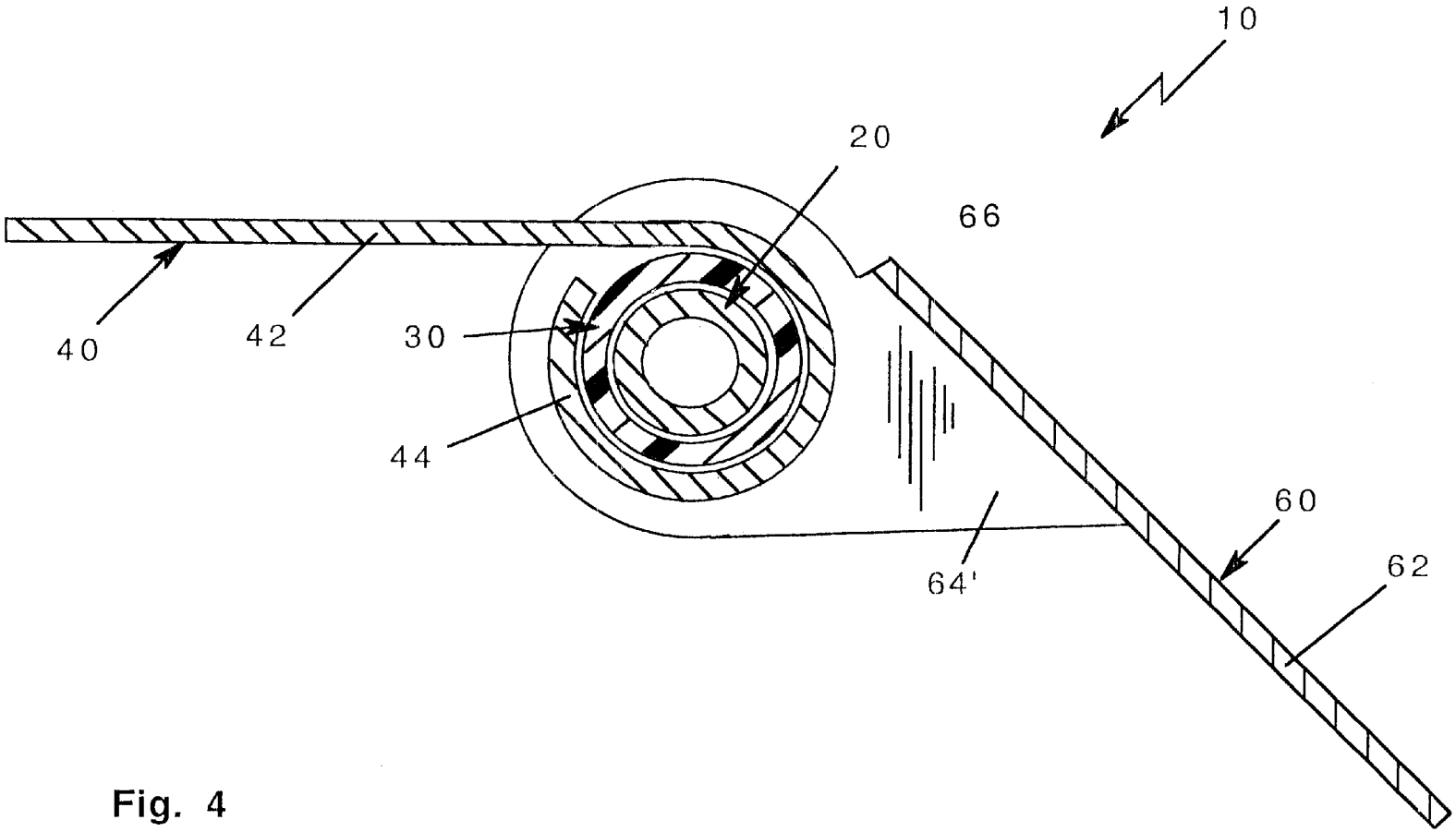
FIG. 4 illustrates a cross-sectional view of the invention taken along line 4—4 in FIG. 1.

Central supporting member 20 is made out of a rigid material, and in one of the preferred embodiments it is a tubular with upper and lower ends 24 and 24', respectively. Ends 24 and 24' include outwardly extending flanges 25 and 25', in the preferred embodiment, and they are rigidly mounted to angular walls 64 and 64' by welded joints 21. Walls 64 and 64' are rigidly and perpendicularly mounted to leaf member 62 of leaf assembly 60 at ends 63 and 63' respectively, as best seen in FIG. 2. Sleeve member 30 journals central portion 22 of supporting member 20 between angular walls 64 and 64'. Sleeve member 30 is rotably mounted over central portion 22. Sleeve member 30 is made out of a plastic self-lubricating polymer material, such as Delrin or equivalent. Delrin is a trademark of E.I. Dupont Nemoms & Co., 1007 Market St., Wilmington, Del.

Leaf assembly 40 includes leaf member 42 and folded portion 44. Folded portion 44 is rotatably mounted over sleeve member 30. Folded portion 44 covers member 30 entirely. The clearances between folded portion 44, member 30 and central tubular member 22 are not tight, but rather slightly loose to avoid frictional forces as much as possible.

Leaf assembly 60 includes leaf member 62, ends 63 and 63', angular walls 64 and 64' and elongated edge 66. Edge 66 limits the movement of leaf assembly 60 so in the open extreme position, leaf assemblies 40 and 60 are disposed in a 180 degrees angle. Additionally, the disposition of edge 66 avoid a user be pinched by the hinge.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hinge assembly comprising:

A) a first leaf assembly having a first flat portion with first and second ends, and including first and second angular walls perpendicularly mounted to said first and second ends, respectively;

B) a supporting member rigidly mounted between said first and second angular walls to prevent any rotational or translational movement of said supporting member relative to said angular walls;

C) a sleeve member rotably mounted over said supporting member; and

D) a second leaf assembly having a second flat portion and a folded portion journaling said sleeve so that said second leaf assembly rotates about said sleeve and supporting member.

2. The hinge assembly set forth in claim 1 wherein said supporting member is a tubular member.

3. The hinge assembly set forth in claim 2 wherein said sleeve is made out of a plastic self-lubricating material.

* * * * *